US008514010B2

(12) United States Patent
Nagata

(10) Patent No.: US 8,514,010 B2
(45) Date of Patent: Aug. 20, 2013

(54) REFERENCE CURRENT GENERATION CIRCUIT AND POWER DEVICE USING THE SAME

(75) Inventor: Takeshi Nagata, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 13/446,660

(22) Filed: Apr. 13, 2012

(65) Prior Publication Data

US 2012/0262227 A1 Oct. 18, 2012

(30) Foreign Application Priority Data

Apr. 15, 2011 (JP) ..... 2011-090944

(51) Int. Cl.
*G05F 1/10* (2006.01)

(52) U.S. Cl.
USPC ..... 327/541

(58) Field of Classification Search
USPC ..... 327/530, 534, 535, 537, 538, 540–543; 323/312, 313
See application file for complete search history.

(56) References Cited

U.S. PATENT DOCUMENTS 6,798,277 B2 * 9/2004 Nakashimo et al. ..... 327/541
7,390,070 B2 * 6/2008 Hiwada et al. ..... 347/10

FOREIGN PATENT DOCUMENTS

JP 05-315852 11/1993
JP 2008-217203 9/2008

* cited by examiner

*Primary Examiner* — Lincoln Donovan
*Assistant Examiner* — Sibin Chen
(74) *Attorney, Agent, or Firm* — Fish & Richardson P.C.

(57) ABSTRACT

There is provided a reference current generation circuit, including a reference voltage generation unit configured to generate a reference voltage by using a depression type transistor, and a voltage/current conversion unit configured to generate a reference current from the reference voltage.

12 Claims, 9 Drawing Sheets

REFERENCE CURRENT GENERATION CIRCUIT AND POWER DEVICE USING THE SAME

CROSS-REFERENCE TO RELATED APPLICATION

This application is based upon and claims the benefit of priority from Japanese Patent Application No. 2011-90944, filed on Apr. 15, 2011, the entire contents of which are incorporated herein by reference.

TECHNICAL FIELD

The present disclosure relates to a reference current generation circuit and a power device using the same.

BACKGROUND

FIG. 8 is a circuit diagram illustrating a conventional power device 200. In the power device 200, an output transistor 204 is controlled such that a feedback voltage Vfb (a divided voltage of an output voltage Vout) and a predetermined reference voltage Vref are equivalent, whereby the desired output voltage Vout is generated from a power source voltage VCC and supplied to a load.

However, the power device 200 involves various problems to be solved, such as a trade-off between a restraint of a leak current of the output transistor 204 and low current consumption, a trade-off between a reduction in an internal power source voltage generation block (PREREG) 201 and low current consumption, etc.

<Trade-Off Between a Restraint of a Leak Current of Output Transistor 204 and Low Current Consumption>

Recently, in the power device 200, the size of the output transistor 204 in both a low drop-out (LDO) regulator IC and a switching regulator IC tends to be increased. If the size of the output transistor 204 is increased, it is likely that a leak current Ileak generated from the output transistor 204 is increased.

If a load is not connected to the power device 200, the leak current Ileak of the output transistor 204 flows through a single path, along which the leak current Ileak of the output transistor 204 flows to a ground terminal through feedback resistors 205 and 206 interposed between the output transistor 204 and the ground terminal. In many cases, a feedback resistance value Rfb (a combined resistance value of the feedback resistors 205 and 206) is set to be somewhat large in order to realize low current consumption of the power device 200. For this reason, if the leak current Ileak of the output transistor 204 flows to the feedback resistors 205 and 206, it is likely that the output voltage Vout is increased to be higher than an intended target value. For example, if the leak current Ileak is 1 μA and the feedback resistance value Rfb is 5 MΩ, the output voltage Vout is increased by 5V as a product of the leak current Ileak and the feedback resistance value Rfb.

In particular, the leak current Ileak of the output transistor 204 is increased as chip temperature Tj is increased. For this reason, the foregoing problem may occur at the surface in the power device 200 (e.g., a power source IC mounted in a vehicle), whose temperature may be high when used.

Further, the foregoing problem may be solved by setting the feedback resistance value Rfb to be small. However, if the feedback resistance value Rfb is set to be small, low current consumption of the power device 200 cannot be realized. Thus, it is not practical to set the feedback resistance value to be small. In addition, the size of the output transistor 204 may be reduced or the power device 200 may be restrained from having a high temperature to suppress the leak current Ileak of the output transistor 204. However, the use of the above mentioned methods brings about another trade-off (i.e., it causes an increase of ON resistance of the output transistor 204, etc).

<Trade-Off Between Reduction in Size of Internal Power Source Voltage Generation Block 201 and Low Current Consumption>

FIG. 9 is a circuit diagram illustrating a conventional reference current generation circuit 300 included in the internal power source voltage generation block 201. In order to reduce current consumption as much as possible in generating the reference current Iref, the reference current generation circuit 300 is configured such that a resistance value of a resistor Rx is set to be great to thus reduce a bias current Ix (a drain current of a transistor M10) flowing at an input side of a current mirror. Thus, in the reference current generation circuit 300, an increase in the resistance value of the resistor Rx leads to an increase in the area of the chip. For example, in order to narrow down the bias current Ix flowing through the resistor Rx to 0.1 μA, a resistance value of the resistor Rx should be set to be tens to hundreds of MΩ (which is equivalent to 10 or more aluminum pads), and this hampers the reduction of the size of the internal power source voltage generation block 201.

Further, in the reference current generation circuit 300, as the power source voltage VCC becomes higher, the bias current Ix is increased. Thus, in order to limit the current consumption of the reference current generation circuit 300 to be small while responding to the input of the high power source voltage VCC, the resistance value of the resistor Rx is required to set to be larger than the above value and the chip area is required to be increased further.

SUMMARY

The present disclosure provides some embodiments of a power device capable of resolving a trade-off between a restraint of a leak current of an output transistor and low current consumption.

Further, the present disclosure provides some embodiments of a reference current generation circuit capable of resolving a trade-off between a reduction in the size of a circuit and low current consumption.

According to the one aspect of the present disclosure, the power device includes an output transistor, a power circuit for generating an output voltage from a power source voltage by using the output transistor, and a leak current absorption circuit for absorbing a leak current of the output transistor by using a depression type transistor.

Further, in the power device having the above configuration, the leak current absorption circuit may have a configuration in which at least one leak current absorption path is provided between an application terminal of the output voltage and a ground terminal.

In addition, in the power device having the above configuration, the leak current absorption path may be configured by connecting at least one depression type transistor having a gate and a source as connected and an enhancement type transistor having a gate and a source as connected, in series between the application terminal of the output voltage and the ground terminal.

Also, in the power device having the above configurations, the power circuit may be configured to have a feedback resistor for dividing the output voltage to generate a feedback voltage and control driving of the output transistor such that the feedback voltage is equivalent to a predetermined reference voltage.

According to one aspect of the present disclosure, the reference current generation circuit includes a reference voltage generation unit configured to generate a reference voltage by using a depression type transistor, and a voltage/current conversion unit configured to generate a reference current from the reference voltage.

Also, in the reference current generation circuit having the above configuration, the reference voltage generation unit is configured to include a depression type first NMOSFET whose gate and source are connected, and an enhancement type second NMOSFET whose gate and drain are connected. In this configuration, the reference voltage is output from a connection node of the source of the first NMOSFET and the drain of the second NMOSFET.

In addition, in the reference current generation circuit having the above configuration, the reference voltage generation unit includes at least one depression type third NMOSFET whose gate and source are connected between an application terminal of a power source voltage and a drain of the first NMOSFET.

Also, in the reference current generation circuit having the above configuration, the reference voltage generation unit includes a fourth NMOSFET whose gate and drain are connected between a source of the second NMOSFET and a ground terminal.

Further, in the reference current generation circuit having the above configuration, the voltage/current conversion unit includes a fifth NMOSFET having a gate connected to the application terminal of the reference voltage and a resistor connected between a source of the fifth NMOSFET and a ground terminal, wherein a current flowing through the resistor is output as the reference current.

In addition, in the reference current generation circuit having the above configuration, the fourth NMOSFET and the fifth NMOSFET have a layout to have pairing property on a semiconductor substrate.

Also, in the reference current generation circuit having the above configurations, the reference voltage generation unit includes a first PMOSFET having a source connected to a drain of the first NMOSFET, a drain connected to a ground terminal, and a gate connected to an application terminal of the reference voltage.

Further, in the reference current generation circuit having the above configuration, the voltage/current conversion unit includes a sixth NMOSFET having a gate connected to the drain of the first NMOSFET and a source connected to a drain of the fifth NMOSFET.

According to another aspect of the present disclosure, the power device includes an internal power source voltage generation block, a reference voltage generation block, and a power block. The internal power source voltage generation block is configured to receive a power source voltage to generate an internal power source voltage. The reference voltage generation block is configured to receive the internal power source voltage to generate a reference voltage. The power block is configured to generate an output voltage from the power source voltage such that a feedback voltage corresponding to the output voltage and the reference voltage are equivalent. In this configuration, the internal power source voltage generation block includes the reference current generation current described in the above configurations, and an internal power source voltage generation circuit configured to generate the internal power source voltage by using the reference current.

Also, in the power device having the above configuration, the reference voltage generation block includes a reference voltage generation circuit configured to generate the reference voltage by using a depression type transistor, and a precharge circuit configured to perform precharging of the reference voltage when the power device operates, upon receiving the internal power source voltage.

In addition, in the power device having the above configuration, the precharge circuit includes a current mirror, a PMOSFET, and an NMOSFET. The current mirror is configured to receive the internal power source voltage to generate a mirror current according to a bias current. The PMOSFET includes a source connected to an output terminal of the mirror current, a drain connected to a ground terminal, and a gate connected to an application terminal of a bias voltage. The NMOSFET includes a drain connected to an application terminal of the internal power source voltage, a gate connected to a source of the PMOSFET, and a source connected to the reference voltage generation circuit.

Further, in the power device having the above configuration, the reference current generation circuit outputs the reference current as the bias current.

Also, in the power device having the above configurations, the reference current generation circuit outputs a voltage appearing at one terminal of the resistor as the bias voltage.

In addition, in the power device having the above configurations, the bias voltage is set to be lower than a target value of the reference voltage.

BRIEF DESCRIPTION OF THE DRAWINGS

Embodiments of the inventive aspects of this disclosure will be understood with reference to the following detailed description, when read in conjunction with the accompanying drawings, in which.

DETAILED DESCRIPTION

Exemplary embodiments of the present disclosure will now be described in detail with reference to the drawings. Reference will now be made in detail to various embodiments, examples of which are illustrated in the accompanying drawings. In the following detailed description, numerous specific details are set forth in order to provide a thorough understanding of the inventive aspects of this disclosure. However, it will be apparent to one of ordinary skill in the art that the inventive aspects of this disclosure may be practiced without these specific details. In other instances, well-known methods, procedures, systems, and components have not been described in detail so as not to unnecessarily obscure aspects of various embodiments.

<Block Diagram>

Figure 1:
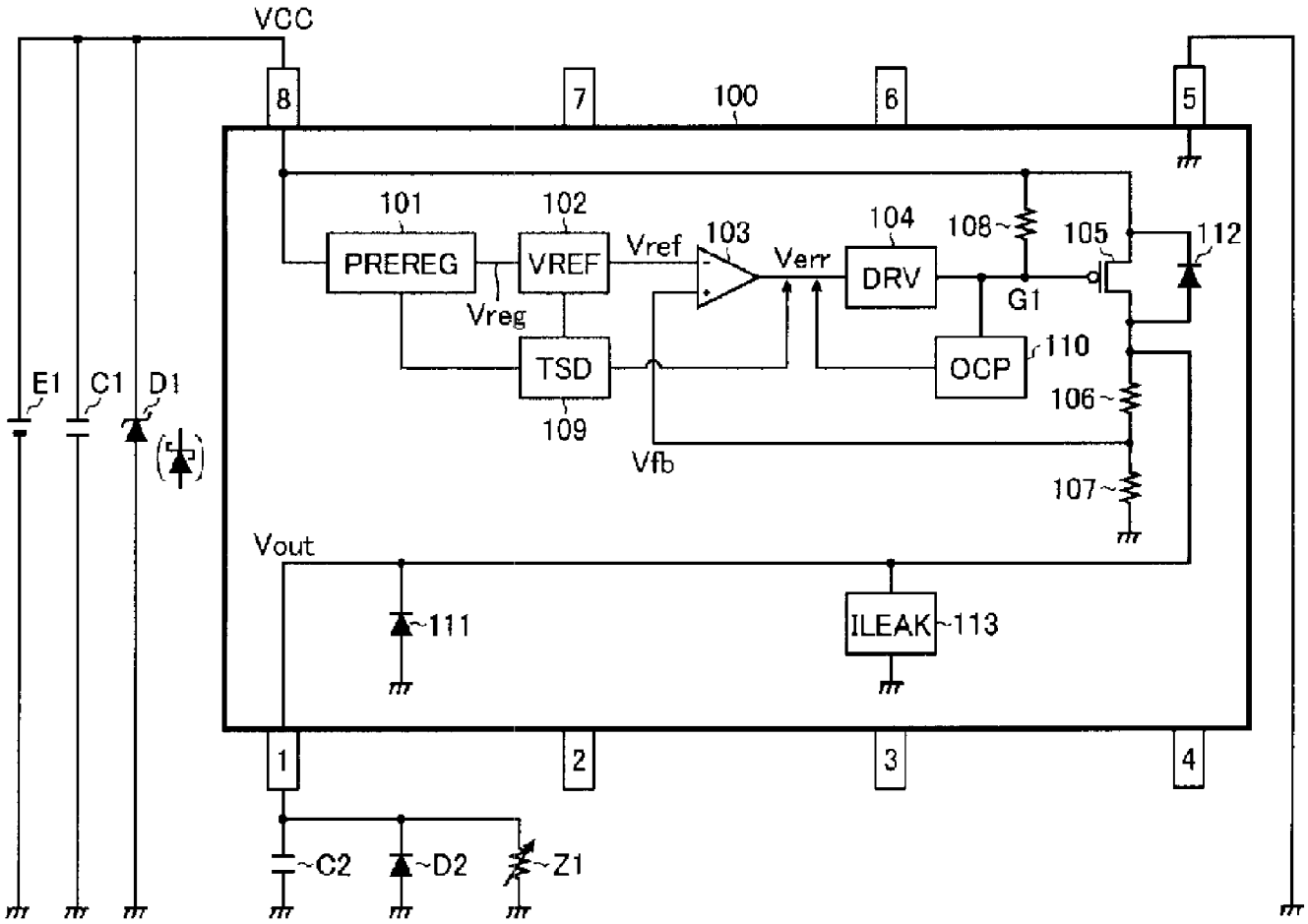
FIG. 1 is a block diagram illustrating a configuration of a power device.

FIG. 1 is a block diagram illustrating a configuration of a power device. The power device is provided as an LDO regulator IC 100 that steps down a power source voltage VCC supplied from a DC voltage source (battery) E1 to generate an output voltage Vout.

The LDO regulator IC 100 is a silicon monolithic IC that includes an internal power source voltage generation block (PREREG) 101, a reference voltage generation block (VREF) 102, an error amplifier 103, a driver (DRV) 104, an output transistor 105, resistors 106 to 108, a temperature protection circuit (TSD) 109, an overcurrent protection circuit (OCP) 110, diodes 111 and 112, and a leak current absorption circuit 113.

Further, in order to establish an external electrical connection, the LDO regulator IC 100 has eight external terminals. A first pin (Vout) is a voltage output terminal. Second to fourth pins (N.C.) are non-connection terminals. A fifth pin GND is a ground terminal. Sixth and seventh pins (N.C.) are non-connection terminals. An eighth pin VCC is a power source voltage input terminal. However, the number of pins may be arbitrarily designed. For example, a 3-terminal IC may be configured by excluding (or omitting) the non-connection terminals (the second to fourth pins, the sixth pin, and the seventh pin).

The internal power source voltage generation block (pre-regulator (PREREG) block) 101 receives the power source voltage VCC to generate an internal power source voltage Vreg. Further, a configuration and an operation of the internal power source voltage generation block 101 will be described in detail later.

The reference voltage generation block 102 receives the internal power source voltage Vreg to generate a reference voltage Vref. Also, a configuration and an operation of the reference voltage generation block 102 will be described in detail later.

The error amplifier 103 amplifies a difference between a feedback voltage Vfb (a divided voltage of the output voltage Vout) and the reference voltage Vref. The feedback voltage Vfb is input to a non-inverting input terminal (+), and the reference voltage Vref input to an inverting input terminal (−) to generate an error voltage Verr.

The driver 104 generates a gate signal G1 of the output transistor 105 such that the error voltage Verr becomes small.

The output transistor is a P channel type MOS field effect transistor (FET). The output transistor is connected between an application terminal (the eighth pin (VCC)) of the power source voltage VCC and an application terminal (the first pin (Vout)) of the output voltage Vout. A source of the output transistor 105 is connected to the eighth pin (VCC), and a drain of the output transistor 105 is connected to the first pin (Vout). Further, a gate of the output transistor 105 is connected to an output terminal (an application terminal of a gate signal G1) of the driver 104. A degree of conduction of the output transistor 105 is controlled according to a voltage value of the gate signal G1. As the output transistor 105, a P channel type double-diffused metal oxide semiconductor field effect transistor (PDMOSFET) having a high withstanding voltage (e.g., a withstanding voltage of 60V) may be used.

The resistors 106 and 107 are connected in series between the application terminal of the output voltage Vout and the ground terminal, and a connection node between the resistors 106 and 107 is connected as an output terminal of the feedback voltage Vfb to the non-inverting input terminal (+) of the error amplifier 103. That is, the resistors 106 and 107 function as divider circuits for dividing the output voltage Vout to generate the feedback voltage Vfb.

The resistor 108 is connected between the application terminal of the power source voltage VCC and the gate of the output transistor 105. When the driver 104 is changed into a non-operational state, the resistor 108 functions as a pull-up resistor that increases the gate signal G1 to have a high level (power source voltage VCC) to turn off the output transistor 105. Further, instead of the resistor 108, an active element (transistor) may be used. Also, the resistor 108 may be installed within the driver 104.

Further, the foregoing error amplifier 103, the driver 104, the output transistor 105, and the resistors 106 to 108 are equivalent to a power block. That is, the power block generates the desired output voltage Vout from the power source voltage VCC by controlling drive of the output transistor 105, such that the feedback voltage Vfb corresponding to the output voltage Vout is equivalent to a predetermined reference voltage Vref.

If the chip temperature Tj is higher than a threshold temperature, the temperature protection circuit 109 forces the output transistor 105 to turn off. On other hand, if the chip temperature Tj is lower than the threshold temperature, the temperature protection circuit 109 automatically releases the forced turn-off state of the output transistor 105 without receiving a reset signal from the outside.

When an output current flowing through the output transistor 105 turns an overcurrent, the overcurrent protection circuit 110 forces the output transistor 105 to turn off the output transistor 105.

The diode 111 is an electrostatic breakdown protection element connected between the application terminal of the output voltage Vout and a ground terminal.

The diode 112 is a body diode parasitic on the output transistor 105. The diode 112 functions as an electrostatic breakdown protection element. The diode 112 is connected between the application terminal of the power source voltage VCC and the application terminal of the output voltage Vout.

The leak current absorption circuit 113 absorbs a leak current of the output transistor 105 by using a depression type transistor. Further, a configuration and an operation of the leak current absorption circuit 113 will be described in detail later.

If a surge exceeding 50V is applied to the eighth pin (VCC), a power Zener diode D1 may be inserted between the eighth pin (VCC) and the ground terminal. If it is likely that the eighth pin (VCC) has a voltage lower than that of the ground terminal, a Schottky diode, instead of the power Zener diode D1, may be inserted. Further, an input smoothing capacitor C1 may be inserted between the eighth pin (VCC) and the ground terminal.

If a load Z1 having a great inductance component is connected to the first pin (Vout) and a generation of counter electromotive force at the time of starting and turning off an output is considered, a protection diode D2 may be inserted between the first pin (Vout) and the ground terminal. Further, an output smoothing capacitor C2 may be inserted between the first pin (Vout) and the ground terminal.

<IC Outline>

The LDO regulator IC 100 is an ultra-low dark current regulator including a high withstanding voltage of 50V, an output voltage precision of ±2%, an output current of 200 mA, and power consumption of 6 μA. The LDO regulator IC 100 is ideal for low current consumption (low dark current) of a battery-directly connected system (a vehicle power system for supplying power to a body-based device, a car stereo, a car navigation, etc). In the LDO regulator IC 100, a ceramic condenser may be used as a phase compensation condenser of the output voltage Vout. The LDO regulator IC 100 includes the temperature protection circuit 109 for preventing a thermal breakdown of an IC due to an overload state, and the overcurrent protection circuit 110 for preventing an IC breakdown due to an output short-circuit.

<Leak Current Absorption Circuit>

Figure 2:
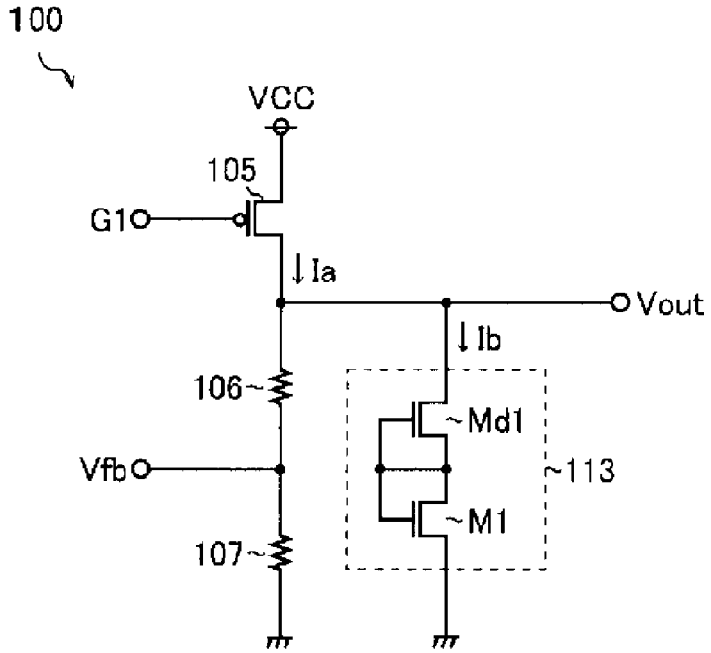
FIG. 2 is a circuit diagram illustrating a configuration of a leak current absorption circuit.

FIG. 2 is a circuit diagram illustrating a configuration of the leak current absorption circuit 113. The leak current absorption circuit 113 includes N channel type MOS FETs Md1 and M1. The transistor Md1 is a depression type transistor, and the transistor M1 is an enhancement type transistor.

A drain of the transistor Md1 is connected to the application terminal of the output voltage Vout. A gate and a source of the transistor Md1 are connected to a gate and a drain of the transistor M1. A source of the transistor M1 is connected to a ground terminal. The transistors Md1 and M1 function as a leak current absorption path connected between the application terminal of the output voltage Vout and the ground terminal.

In this manner, in the leak current absorption circuit 113, the depression type transistor Md1 is connected to the application terminal of the output voltage Vout, and a leak current Ia of the output power transistor 105 is absorbed by using a leak current Ib of the transistor Md1. The leak current Ib is increased at a high temperature.

Figure 3:
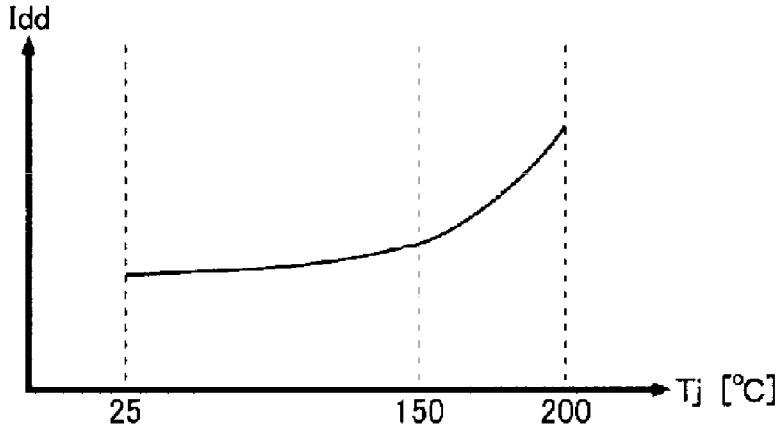
FIG. 3 is a view illustrating a relationship between a chip temperature Tj and a drain current Idd.

FIG. 3 is a view illustrating a relationship between the chip temperature Tj (degrees C.) of the LDO regulator IC 100 and a drain current Idd (including the leak current Ib) of the transistor Md1.

When the chip temperature Tj is low, the leak current Ib of the transistor Md1 is scarcely generated, so the drain current Idd of the transistor Md1 is biased to have a considerably small value (about 0.1 μA). Thus, the leak current absorption circuit 113 does not hinder a general operation of the LDO regulator IC 100. Meanwhile, if the chip temperature Tj is increased, the leak current Ib is generated in the transistor Md1, thereby increasing the drain current Idd of the transistor Md1. Similarly, if the chip temperature Tj is increased, the leak current Ia generated from the output transistor M1 is also increased.

Since the transistor Md1 is connected to the application terminal of the output voltage Vout, when the LDO regulator IC 100 has a high temperature, the leak current Ia generated from the output transistor 105 flows through a current path including the transistors Md1 and M1 to the ground terminal, rather than flowing to the feedback resistors 106 and 107. Accordingly, an unintentional increase in the output voltage Vout resulting from the leak current Ia of the output transistor 105 can be prevented without lowering a resistance value of the feedback resistors 106 and 107, thereby resolving a trade-off between a restraint of the leak current of the output transistor 105 and low current consumption.

Further, since there is no need to reduce the size of the output transistor 105 or to restrain the LDO regulator IC 100 from having a high temperature, no trade-off (an increase in ON resistance of the output transistor 204) other than the above-mentioned may be caused.

Figure 4:
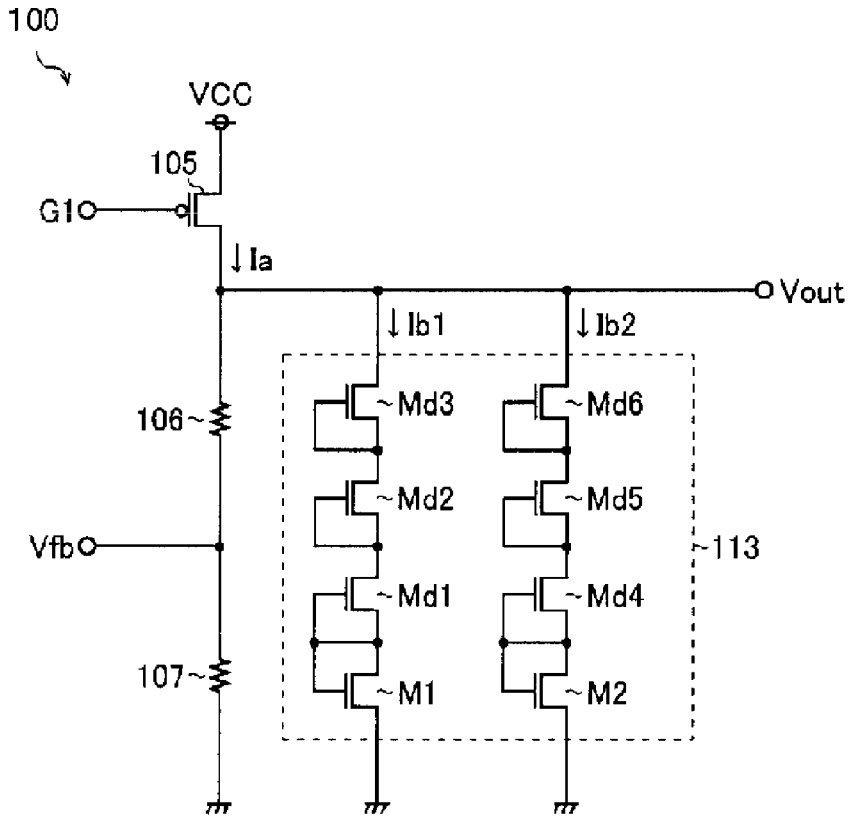
FIG. 4 is a circuit diagram illustrating a modified leak current absorption circuit.

FIG. 4 is a circuit diagram illustrating a modified leak current absorption circuit 113. In FIG. 4, a plurality of depression type transistors Md1 to Md3, whose gates and sources are connected to each other, are connected in series between the application terminal of the output voltage Vout and the drain of the enhancement type transistor M1. By employing such a configuration, a withstanding voltage of the overall circuit can be increased by distributing respective voltages applied to the transistors Md1 to Md3.

Further, a plurality of leak current absorption paths obtained by combining the depression type transistors and the enhancement type transistor are prepared. Specifically, the leak current absorption circuit 113 includes a first leak current absorption path for generating a leak current Ib1 by using the transistors M1 and Md1 to Md3 and a second leak current absorption path for generating the leak current Ib2 by using the transistor M2 and Md4 to Md6. By employing such a configuration, a leak current absorption amount of the leak current absorption circuit 113 (=Ib1+Ib2) can be adjusted to correspond to a leak current Ia of the output transistor 105.

<Internal Power Source Voltage Generation Block and Reference Voltage Generation Block>

Figure 5:
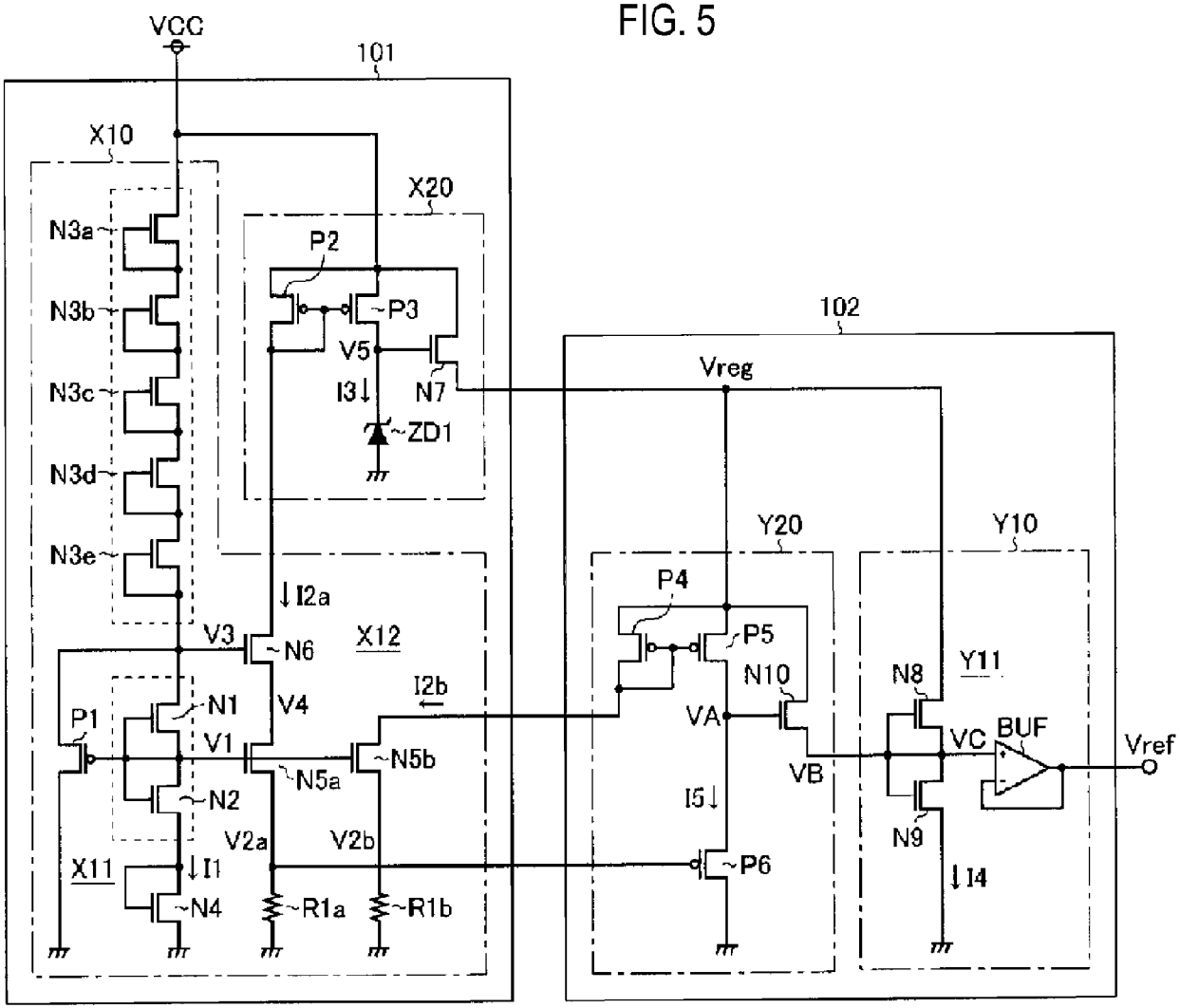
FIG. 5 is a circuit diagram illustrating a configuration of an internal power source voltage generation block and a reference voltage generation block.

FIG. 5 is a circuit diagram illustrating a configuration of the internal power source voltage generation block 101 and the reference voltage generation block 102.

The internal power source voltage generation block 101 includes a reference current generation circuit X10 and an internal power source voltage generation circuit X20. The reference current generation circuit X10 generates reference currents I2*a* and I2*b* upon receiving the power source voltage VCC. The internal power source voltage generation circuit X20 generates the internal power source voltage Vreg upon receiving the power source voltage VCC.

The reference voltage generation block 102 includes a reference voltage generation circuit Y10 and a precharge circuit Y20. The reference voltage generation circuit Y10 generates the reference voltage Vref upon receiving the internal power source voltage Vreg. Upon receiving the internal power source voltage Vreg, the precharge circuit Y20 performs precharging the reference voltage Vref when the LDO regulator IC 100 operates.

The reference current generation circuit X10 includes N channel type MOS FETs N1 to N6, a P channel type MOS FET Pb, and resistors R1*a* and R1*b*. The transistors N1 and N3*a* to N3*e* are all depression type transistors, and the transistors N2, N4, N5*a*, N5*b*, N6, and P1 are all enhancement type transistors.

A drain of the transistor N1 is connected to the application terminal of the power source voltage VCC through the transistors N3*a* to N3*e*. A gate and a source of the transistor N1 are connected to a gate and a drain of the transistor N2. A source of the transistor N2 is connected to a gate and a drain of the transistor N4. A source of the transistor N4 is connected to a ground terminal.

A drain of the transistor N3*a* is connected to the application terminal of the power source voltage VCC. A gate and a source of the transistor N3*a* are connected to a drain of the transistor N3*b*. A gate and a source of the transistor N3*b* are connected to a drain of the transistor N3*c*. A gate and a source of the transistor N3*c* are connected to a drain of the transistor N3*d*. A gate and a source of the transistor N3*d* are connected to a drain of the transistor N3*e*. A gate and a source of the transistor N3*e* are connected to the drain of the transistor N1.

A drain of the transistor N5*a* is connected to a source of the transistor N6. A source of the transistor N5*a* is connected to a ground terminal through the resistor R1*a*. A gate of the transistor N5*a* is connected to an application terminal (a connection node of the source of the transistor N1 and the drain of the transistor N2) of a reference voltage V1. A gate of the transistor N6 is connected to the drain of the transistor N1. A source of the transistor N5*b* is connected to a ground terminal through the resistor R1*b*. A gate of the transistor N5*b* is connected to the application terminal of the reference voltage V1. A source of the transistor P1 is connected to the drain of the transistor N1. A drain of the transistor P1 is connected to a ground terminal. A gate of the transistor P1 is connected to the application terminal of the reference voltage V1.

The internal power source voltage generation circuit X20 includes an N channel type MOS FET N7, P channel type MOS FETs P2 and P3, and a Zener diode ZD1. The transistors N7, P2, and P3 are all enhancement type transistors.

Sources of the transistors P2 and P3 and the drain of the transistor N7 are all connected to the application terminal of the power source voltage VCC. The drain of the transistor P2 is connected to the drain of the transistor N6. Gates of the transistor P2 and P3 are connected to the drain of the transistor P2. A drain of the transistor P3 and a gate of the transistor N7 are all connected to a cathode of the Zener diode ZD1. An anode of the Zener diode ZD1 is connected to a ground terminal. A source of the transistor N7 is connected to the application terminal of the internal power source voltage Vreg.

The reference voltage generation circuit Y10 includes N channel type MOS FETs N8 and N9 and a buffer BUF. The transistor N8 is a depression type transistor, and the transistor N9 is an enhancement type transistor. A drain of the transistor N8 is connected to the application terminal of the internal power source voltage Vref. A gate and a source of the transistor N8 are connected to a gate and a drain of the transistor N9. A source of the transistor N9 is connected to a ground terminal. A non-inverting input terminal (+) of the buffer BUF is connected to an application terminal (a connection node of the source of the transistor N8 and the drain of the transistor N9) of a voltage VC. An inverting input terminal (−) of the buffer BUF is connected to an output terminal of the buffer BUF. The output terminal of the buffer BUF is connected to the application terminal of the reference voltage Vref.

The precharge circuit Y20 includes an N channel type MOS FET N10 and P channel type MOS FETs P4 to P6. The transistors N10 and P4 to P6 are all enhancement type transistors. Sources of the transistors P4 and P5 and a drain of the transistor N10 are all connected to the application terminal of the internal power source voltage Vreg. A drain of the transistor P4 is connected to the drain of the transistor N5*b*. Gates of the transistors P4 and P5 are connected to the drain of the transistor P4. A drain of the transistor P5 and a gate of the transistor N10 are all connected to a source of the transistor P6. A drain of the transistor P6 is connected to a ground terminal. A gate of the transistor P6 is connected to an application terminal (a connection node of the source of the transistor N5*a* and a resistor R1*a*) of a voltage V2*a*. A source of the transistor N10 is connected to an application terminal of the voltage VC.

<Reference Current Generation Circuit>

In the reference current generation circuit X10, the transistors N1 to N4 and P1 are equivalent to a reference voltage generation unit X11 (a so-called depression type reference voltage source) for generating the reference voltage V1 by using the depression type transistor N1. Further, the transistors N5*a*, N5*b* and N6, and resistors R1*a* and R1*b* are equivalent to a voltage/current conversion unit X12 for generating the reference currents I2*a* and I2*b* from the reference voltage V1.

Figure 6:
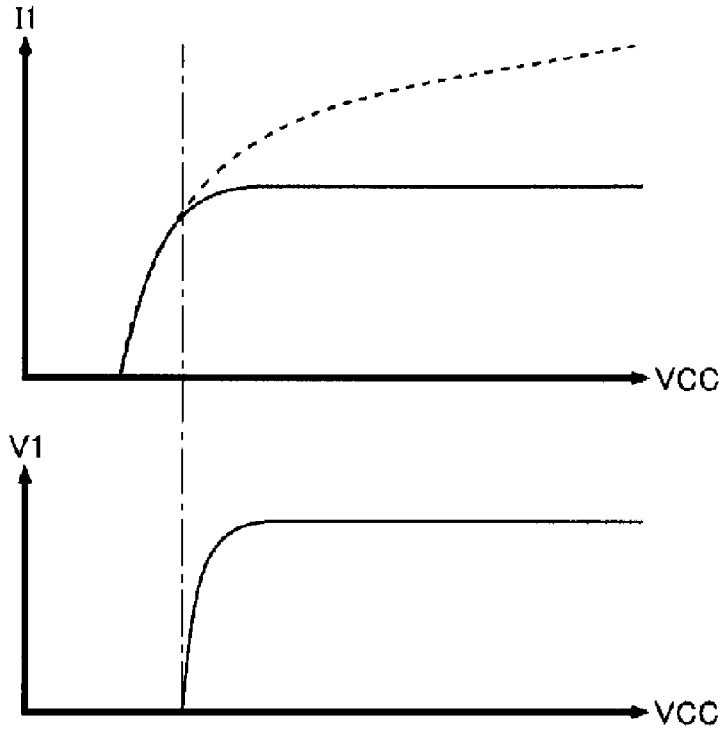
FIG. 6 is a view illustrating a relationship among a power source voltage VCC, a current I1, and a voltage V1.

The current I1 is consumed by the reference voltage generation unit X11, and is biased to have a considerably small current value (about 0.1 μA), without relying on the power source voltage VCC (see an upper portion in FIG. 6). Accordingly, in the reference voltage generation unit X11, although the power source voltage VCC is increased, the uniform reference voltage V1 can continuously output from the connection node of the source of the transistor N1 and the drain of the transistor N2 without increasing the current I1 (see a lower portion in FIG. 6).

Figure 9:
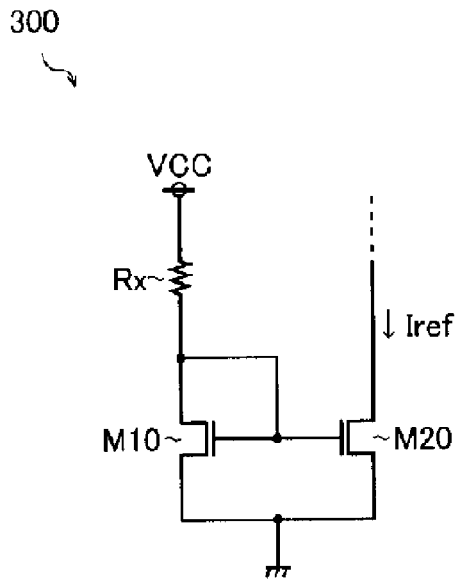
FIG. 9 (PRIOR ART)
FIG. 9 is a circuit diagram illustrating a conventional reference current generation circuit.

Thus, the reference current generation circuit X10 is configured to generate the reference currents I2*a* and I2*b* by converting voltage/current of the reference voltage V1 through use of the foregoing characteristics of the reference voltage generation unit X11. If such a configuration is employed, unlike the configuration of FIG. 9, current consumption of the reference current generation circuit X10 can be reduced without setting a high resistance value, so a trade-off between the reduction in the size of the reference current generation circuit X10 and low current consumption can be resolved. For example, if such a current consumption value as that of the related art configuration is realized, the size of the reference current generation circuit X10 can be reduced to be about ⅓ of that of the related art configuration.

Further, the reference voltage generation unit X11 includes a plurality of depression type transistors N3*a* to N3*e* whose gates and sources are connected, between the application terminal of the power source voltage VCC and the drain of the transistor N1. With this configuration, respective voltages applied to each of the transistor N1 and N3*a* to N3*e* can be distributed to enhance a withstanding voltage of the overall circuit. In particular, if the LDO regulator IC 100 is used as a power source of a device for a vehicle required to have a low dark current and a high withstanding voltage, the foregoing configuration can be considered to be greatly effective.

Also, the reference voltage generation unit X11 includes the transistor N4 having a gate and a drain connected between the source of the transistor N2 and a ground terminal. With such a configuration, the reference voltage V1 can be increased to be as high as a voltage Vgs (N4) between the gate and the source of the transistor N4.

In addition, the voltage/current conversion unit X12 includes the transistors N5*a* and N5*b* whose gates are connected to the application terminal of the reference voltage V1. Further, the voltage/current conversion unit X12 includes resistors R1*a* and R1*b* connected between the sources of the transistors N5*a* and N5*b* and a ground terminal, and outputs a current flowing through the resistors R1*a* and R1*b*, as reference currents I2*a* and I2*b*. With such a configuration, a voltage V2*a* (=V1−Vgs (N5*a*)) is obtained by lowering the reference voltage V1 as low as the voltage Vgs (N5*a*) between the gate and source of the transistor N5*a*, and applied to the resistor R1*a*. Further, a voltage V2*b* (=V1−Vgs (N5*b*)) is obtained by lowering the reference voltage V1 as low as the voltage Vgs (N5*b*) between the gate and source of the transistor N5*b*, and applied to the resistor R1*b*.

Here, the transistor N4 and the transistors N5*a* and N5*b* have a layout to have pairing property on a semiconductor substrate. With such a configuration, the voltage Vgs (N4) between the gate and the source of the transistor N4 and the Vgs (N5*a*) and Vgs (N5*b*), between the gates and sources of the transistors N5*a* and N5*b* can be adjusted to have an identical value. As a result, the respective voltages V2*a* and V2*b* applied to the resistors R1*a* and R1*b* can be adjusted to be substantially equivalent to the voltage Vgs (N2) (i.e., the voltage value set only by the depression type reference voltage sources (N1 and N2)) between the gate and the source of the transistor N2.

In addition, the reference voltage V1 generated from the reference voltage generation unit X11 has flat temperature characteristics. Further, by securing the pairing property of the transistors N4 and N5, a bias between the transistors N4 and N5 is relatively canceled out. Thus, it is possible to generate the reference currents I2*a* and I2*b* having flat temperature characteristics by converting voltage/current the reference voltage V1.

In this respect, however, since the depression type transistor has a low withstanding voltage in terms of structure, it can be hardly used when a voltage greatly fluctuates or when a high voltage is applied. Thus, the reference voltage generation unit X11 is configured to include the transistor P1 having a source connected to the drain of the transistor N1, a drain connected to a ground terminal, and a gate connected to the application terminal of the reference voltage V1. Further, as the transistor P1, a PDMOSFET having a high withstanding voltage (e.g., a withstanding voltage of 60V) may be used.

Figure 7:
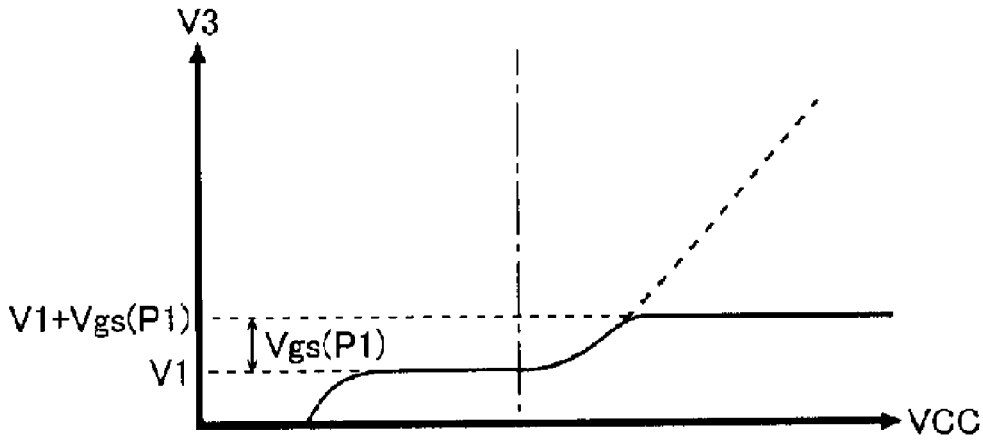
FIG. 7 is a view illustrating a relationship between the power source voltage VCC and a voltage V3.
Figure 8:
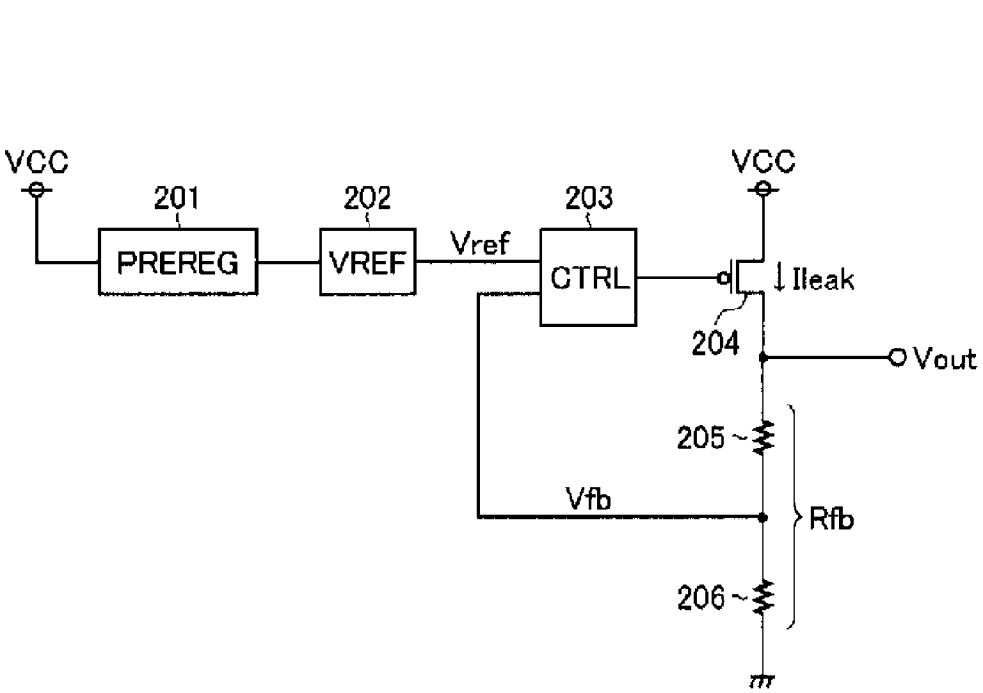
FIG. 8 (PRIOR ART)
FIG. 8 is a circuit diagram illustrating a conventional power device.

With such a configuration, as shown in FIG. 7, although the terminal voltage V3 (or a voltage of a contact terminal of a buried layer (B/L)) of the drain of the transistor N1 is maximized, the terminal voltage V3 can be increased up to a voltage (=V1+Vgs (P1)) as high as the voltage Vgs (P1) between the gate and the source of the transistor P1 from the reference voltage V1. Thus, the terminal voltage V3 (or the voltage of the contact terminal of the B/L)) of the drain of the transistor N1 can be clamped such that it is not greater than the withstanding voltage of the element by inserting the transistor P1.

Further, as mentioned above, the plurality of depression type transistors N3*a* to N3*e* are connected in series between the application terminal of the power source voltage VCC and the drain of the transistor N1. Thus, the source of the transistor P1 is connected to a connection node of the source of the transistor N3*e* and the drain of the transistor N1, rather than to the application terminal of the power source voltage VCC. With such a configuration, the current flowing through the transistor P1 can be limited.

In addition, the voltage/current conversion unit X12 includes the transistor N6 having a gate connected to the drain of the transistor N1 and a source connected to the drain of the transistor N5*a*. Also, as the transistor N6, an NDMOSFET having a high withstanding voltage (e.g., a withstanding voltage of 60V) may be used. With such a configuration, the terminal voltage V4 of the drain of the transistor N5*a* is pre-regulated to a voltage (=V3−Vgs (N6)) as low as the voltage Vgs (N6) between the gate and the source of the transistor N6 from the terminal voltage V3 of the drain of the transistor N1, rather than relying on the power source voltage VCC.

<Internal Power Source Voltage Generation Circuit>

In the internal power source voltage generation circuit X20, the transistors P2 and P3 form a current mirror for generating a mirror current I3 corresponding to the reference current I2*a* upon receiving the power source voltage VCC. The mirror current I3 flows to a ground terminal through the Zener diode ZD1. A cathode voltage V5 of the Zener diode ZD1 is supplied to the gate of the transistor N7. Accordingly, the internal power source voltage Vreg (=V5−Vgs (N7)) as low as the voltage Vgs (N7) between the gate and the source of the transistor N7 from the cathode voltage V5 of the Zener diode ZD1 appears at the source of the transistor N7. Further, as the transistors P2 and P3 and the transistor N7, a PDMOSFET and an NDMOSFET each having a high withstanding voltage (e.g., a withstanding voltage of 60V) may be used.

<Reference Voltage Generation Circuit>

In the reference voltage generation circuit Y10, the transistors N8 and N9 are equivalent to the reference voltage generation unit Y11 (so-called depression type reference voltage source) that generates the voltage VC (=reference voltage Vref) by using the depression type transistor N8. The buffer BUF outputs the voltage VC as a reference voltage Vref.

The current I4 consumed in the reference voltage generation unit Y11 is biased to have a considerably small current value (about 0.1 μA), rather than relying on the internal power source voltage Vreg, so it is appropriate for low current consumption. However, when the current I4 is small, it means that the reference voltage generation unit Y11 has a significantly high impedance component in the operation of the LDO regulator IC 100. In other words, if the LDO regulator IC 100 operates, a long time (a start time of the reference voltage Vref) is required until a sufficient current I4 starts to flow through the reference voltage generation unit Y11. In particular, if the LDO regulator IC 100 is used in a low temperature state, the current I4 is further reduced, so a longer time is required to start the reference voltage Vref.

<Precharge Circuit>

Thus, the reference voltage generation block 102 includes the precharge circuit Y20 for performing precharging (assisting operation) of the reference voltage Vref when the LDO regulator IC 100 operates, upon receiving the internal power source voltage Vreg.

In the precharge circuit Y20, the transistors P4 and P5 form a current mirror that generates a mirror current I5 corresponding to the reference current I2*b* upon receiving the internal power source voltage Vreg. The mirror current I5 flows to a ground terminal through the transistor P6. A voltage VA (=V2*a*+Vgs (P6)) appears at the source of the transistor P6, which is larger than the bias voltage V2*a* applied to the gate of the transistor P6 by the voltage Vgs (P6) between the gate and the source of the transistor P6. The voltage VA is supplied to the gate of the transistor N10. Thus, the voltage VB (=VA−Vgs (N10)=V2*a*+Vgs (P6)−Vgs (N10)) appears at the source of the transistor N10, which is lowered by the voltage Vgs (N10) between the gate and the source of the transistor N10 than the voltage VA. Accordingly, if the voltages Vgs (P6) and Vgs (N10) between the gates and the sources of the transistors P6 and N10 are equivalent and the pairing property of the transistors P6 and N10 is secured on the semiconductor substrate, the voltage VB is substantially equivalent to the bias voltage V2*a*. That is, the transistors P6 and N10, which are so-called a single-piece buffer, transfer the bias voltage V2*a* to the reference voltage generation circuit Y10. Further, as the transistors P6 and N10, a bipolar transistor may be used instead of an FET.

When the LDO regulator IC 100 operates, the current mirror (P4 and P5) of the precharge circuit Y20 first starts to operate before the reference voltage generation circuit Y10 does, and then, the single-piece buffer (P6 and N10) start to operate. The bias voltage V2*a* from the internal power source voltage generation block 101, which starts the earliest among the circuit blocks included in the LDO regulator IC 100, is applied to the gate of the transistor P6. As mentioned above, the bias voltage V2*a* is transferred to the reference voltage generation circuit Y10 (more specifically, the application terminal of the voltage VC) through the single-piece buffer (P6 and N10).

An input terminal of the buffer BUF is formed as an N channel type FET. In this case, the bias voltage V2*a* may be set to be lower than a final target value of the voltage VC (eventually, the reference voltage Vref). Through such setting, when the reference voltage generation circuit Y10 is operating (V2*a*>VC), precharging (assisting operation) of the reference voltage Vref is executed by using the bias voltage V2*a*. Thereafter, when the operation of the reference voltage generation circuit Y10 is completed (V2*a*<VC), the voltage VC have priority over the bias voltage V2*a*, and the buffer BUF outputs the voltage VC as the reference voltage Vref. Thus, the precharge circuit Y20 can be employed to appropriately perform precharging (assisting operation) of the reference voltage Vref only when the LDO regulator IC operates.

<Other Modifications>

Further, the technique for resolving a trade-off between a restraint of a leak current of an output transistor and low current consumption, among various technical features disclosed in the present disclosure, can also be applicable to a general power device (commercial switching regulator IC, etc) employing an output transistor, as well as to a vehicle-mounted LDO regulator IC.

In addition, the technique for resolving a trade-off between a reduction in size of the reference current generation circuit and low current consumption, among various technical features disclosed in the present disclosure, can also be applicable to a general reference current generation circuit provided for a different purpose, as well as to the reference current generation circuit mounted in the vehicle-mounted LDO regulator IC.

According to some embodiments of the present disclosure, the power device capable of resolving a trade-off between a restraint of a leak current of the output transistor and low current consumption can be provided.

Further, according to some embodiments of the present disclosure, the reference current generation circuit capable of resolving a trade-off between a reduction in the size of a circuit and low current consumption can be provided.

The present disclosure can be used, for example, as a technique for enhancing an added value of a vehicle-mounted LDO regulator IC.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The various embodiments are not necessarily mutually exclusive as aspects of one embodiment can be combined with aspects of another embodiment. The accompanying claims and their equivalents are intended to cover such forms or modifications as would fall within the scope and spirit of the disclosures.

What is claimed is:

1. A reference current generation circuit, comprising:

a reference voltage generation unit configured to generate a reference voltage by using a depletion type transistor; and a voltage/current conversion unit configured to generate a reference current from the reference voltage, wherein the reference voltage generation unit includes a depletion type first NMOSFET whose gate and source are connected and an enhancement type second NMOSFET whose gate and drain are connected, wherein the reference voltage is output from a connection node of the source of the first NMOSFET and the drain of the second NMOSFET, wherein the voltage/current conversion unit includes a third NMOSFET having a gate connected to an application terminal of the reference voltage, and a resistor connected between a source of the third NMOSFET and a ground terminal, and wherein a current flowing through the resistor is output as the reference current.

2. The reference current generation circuit of claim 1, wherein the reference voltage generation unit includes at least one depletion type fourth NMOSFET whose gate and source are connected between an application terminal of a power source voltage and a drain of the first NMOSFET.

3. The reference current generation circuit of claim 1, wherein the reference voltage generation unit includes a fifth NMOSFET whose gate and drain are connected between a source of the second NMOSFET and a ground terminal.

4. The reference current generation circuit of claim 3, wherein the fifth NMOSFET and the third NMOSFET are configured to have pairing property on a semiconductor substrate.

5. The reference current generation circuit of claim 1, wherein the reference voltage generation unit includes a first PMOSFET having a source connected to the drain of the first NMOSFET, a drain connected to a ground terminal, and a gate connected to the application terminal of the reference voltage.

6. The reference current generation circuit of claim 5, wherein the voltage/current conversion unit includes a sixth NMOSFET having a gate connected to the drain of the first NMOSFET and a source connected to a drain of the fifth third NMOSFET.

7. A power device, comprising:

an internal power source voltage generation block configured to receive a power source voltage to generate an internal power source voltage;

a reference voltage generation block configured to receive the internal power source voltage to generate a reference voltage; and a power block configured to generate an output voltage from the power source voltage such that a feedback voltage corresponding to the output voltage and the reference voltage are equivalent, wherein internal power source voltage generation block comprises:

the reference current generation circuit described in claim 1; and an internal power source voltage generation circuit configured to generate the internal power source voltage by using the reference current.

8. The power device of claim 7, wherein the reference voltage generation block includes:

a reference voltage generation circuit configured to generate the reference voltage by using a depletion type transistor; and a precharge circuit configured to perform precharging of the reference voltage when the power device operates, upon receiving the internal power source voltage.

9. The power device of claim 8, wherein the precharge circuit includes:

a current mirror configured to generate a mirror current corresponding to a bias current upon receiving the internal power source voltage;

a PMOSFET including a source connected to an output terminal of the minor current, a drain connected to a ground terminal, and a gate connected to an application terminal of a bias voltage; and an NMOSFET including a drain connected to an application terminal of the internal power source voltage, a gate connected to a source of the PMOSFET, and a source connected to the reference voltage generation circuit.

10. The power device of claim 9, wherein the reference current generation circuit outputs the reference current as the bias current.

11. The power device of claim 9, wherein the reference current generation circuit outputs a voltage appearing at one terminal of the resistor as the bias voltage.

12. The power device of claim 9, wherein the bias voltage is set to be lower than a target value of the reference voltage.

* * * * *